US010598073B2

(12) United States Patent
Hideshima et al.

(10) Patent No.: US 10,598,073 B2
(45) Date of Patent: Mar. 24, 2020

(54) EXHAUST SYSTEM OF INTERNAL COMBUSTION ENGINE

(71) Applicant: HONDA MOTOR CO., LTD., Tokyo (JP)

(72) Inventors: Minoru Hideshima, Wako (JP); Noritaka Yamamoto, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 37 days.

(21) Appl. No.: 15/981,007

(22) Filed: May 16, 2018

(65) Prior Publication Data

US 2018/0334944 A1 Nov. 22, 2018

(30) Foreign Application Priority Data

May 19, 2017 (JP) ..... 2017-099940

(51) Int. Cl.
*F01N 1/00* (2006.01)
*F01N 13/00* (2010.01)
*F01N 13/10* (2010.01)

(52) U.S. Cl.
CPC ..... *F01N 13/008* (2013.01); *F01N 13/10* (2013.01); *F01N 13/107* (2013.01); *F01N 2340/06* (2013.01); *F01N 2560/025* (2013.01)

(58) Field of Classification Search
CPC ..... F01N 13/008; F01N 13/107; F01N 13/10
(Continued)

(56) References Cited

U.S. PATENT DOCUMENTS 4,484,440 A * 11/1984 Oki ..... F01N 13/08 60/276
2002/0083703 A1* 7/2002 Werth ..... F01N 1/06 60/323

(Continued)

FOREIGN PATENT DOCUMENTS

DE 4127633 A1 * 2/1993 ..... F01N 3/28
JP 52-133814 U 10/1977

(Continued)

OTHER PUBLICATIONS

Office Action dated Mar. 26, 2019, issued in counterpart JP Application No. 2017-099940, with English machine translation. (4 pages).

(Continued)

*Primary Examiner* — Jason D Shanske
(74) *Attorney, Agent, or Firm* — Westerman, Hattori, Daniels & Adrian, LLP

(57) ABSTRACT

An exhaust system includes a turbine housing and an air-fuel ratio sensor. The turbine housing includes a first collecting exhaust pipe including a first passage, a second collecting exhaust pipe including a second passage, and a junction exhaust pipe including a junction passage. The first passage and the second passage are arranged in parallel. When an inner wall forming the junction passage is defined into a first continuous inner wall and a second continuous inner wall, the air-fuel ratio sensor is provided in the first continuous inner wall so as to protrude toward the center of the junction passage. A guide portion that protrudes toward the center of the junction passage is provided in the first continuous inner wall on the upstream side of the air-fuel ratio sensor.

9 Claims, 5 Drawing Sheets

(58) Field of Classification Search
USPC ..... 60/323
See application file for complete search history.

(56) References Cited

U.S. PATENT DOCUMENTS

| | | | | |
|---|---|---|---|---|
| 2004/0020195 | A1* | 2/2004 | Ashida | F01N 13/1805 60/302 |
| 2008/0110163 | A1* | 5/2008 | Nagasaki | F01N 13/10 60/323 |
| 2015/0089923 | A1* | 4/2015 | Henderson, IV | F01N 3/101 60/274 |

FOREIGN PATENT DOCUMENTS

| | | | |
|---|---|---|---|
| JP | 55-020611 | U1 | 2/1980 |
| JP | 58-162225 | U | 10/1983 |
| JP | 62-126512 | U | 8/1987 |
| JP | 63-52916 | U | 4/1988 |
| JP | 2002-266635 | A | 9/2002 |
| JP | 2008-51006 | A | 3/2008 |

OTHER PUBLICATIONS

Office Action dated Nov. 20, 2018, issued in counterpart Japanese Application No. 2017-099940, with English machine translation. (9 pages).

* cited by examiner

EXHAUST SYSTEM OF INTERNAL COMBUSTION ENGINE

CROSS REFERENCES TO RELATED APPLICATIONS

The present application claims priority under 35 U.S.C. § 119 to Japanese Patent Application No. 2017-099940, filed May 19, 2017, entitled "EXHAUST SYSTEM OF INTERNAL COMBUSTION ENGINE." The contents of this application are incorporated herein by reference in their entirety.

TECHNICAL FIELD

The present disclosure relates to an exhaust system of an internal combustion engine. More specifically, the disclosure relates to an exhaust system that includes an exhaust member constituting a part of an exhaust passage through which exhaust gas of a multi-cylinder internal combustion engine flows.

BACKGROUND

Heretofore, exhaust gas discharged from combustion chambers of cylinders of a multi-cylinder internal combustion engine have been collected by a collecting pipeline, which is configured by bundling pipes of a number corresponding to the number of cylinders. Additionally, in such a multi-cylinder internal combustion engine, an exhaust gas sensor for detecting the state of exhaust gas such as a temperature sensor and an air-fuel ratio sensor is provided in a part of the collecting pipeline where streams of exhaust gas from the cylinders merge. However, in this case, in order for a single exhaust gas sensor to uniformly detect the state of exhaust gas discharged from the cylinders, the exhaust gas sensor needs to be provided is a position where the exhaust gas from, the cylinders evenly hit a detector of the exhaust gas sensor.

For example, in order to allow the exhaust gas from the cylinders to evenly hit a detector of an exhaust gas sensor, Japanese Utility Model Registration Application Publication No. Sho 62-126512 discloses a technique in which an exhaust gas sensor is provided substantially parallel to the flow direction of exhaust gas, so that a detector of the exhaust gas sensor protrudes into the center of an exhaust gas-merging part. Meanwhile, Japanese Utility Model Registration Application Publication No. Sho 58-162225 discloses a technique in which an extension chamber is provided at the center of an exhaust manifold, the exhaust gas is introduced into the extension chamber from the right and left thereof through curved passages, and an exhaust gas sensor is provided inside the extension chamber.

SUMMARY

As has been described, introducing exhaust gas from both right and left sides and providing an exhaust gas sensor in a position where the streams of exhaust gas merge is a well-known technique. However, in an actual vehicle, various parts including an engine, a radiator, and an exhaust emission control device need to be provided inside an engine room, and various limitations are set on the structure of an exhaust pipe. For this reason, it may sometimes be impossible to introduce the exhaust gas from both right and left opposite directions, or to provide an exhaust gas sensor in a part where the exhaust gas introduced from the right and left merge, as disclosed in the technique of the above two Japanese publications.

Thus, it is preferable to provide an exhaust system of an internal combustion engine that allows exhaust gas from cylinders to evenly hit an exhaust gas sensor.

(1) In one embodiment, an exhaust system (e.g., later-mentioned exhaust system 1) of an internal combustion engine (e.g., later-mentioned internal combustion engine 2) includes: an exhaust member (e.g., later-mentioned turbine housing 4) that constitutes a part of an exhaust passage through which exhaust gas of a multi-cylinder internal combustion engine flows; and an exhaust gas sensor (e.g., later-mentioned air-fuel ratio sensor 16) that is provided in the exhaust member. The exhaust member includes a first collecting exhaust pipe (e.g., later-mentioned first collecting exhaust pipe 44) in which a first passage (e.g., later-mentioned first passage 13) through which the exhaust gas from combustion chambers of a first cylinder group (e.g., later-mentioned cylinders CY1, CY4) of the internal combustion engine flows is formed, a second collecting exhaust pipe (e.g., later-mentioned second collecting exhaust pipe 45) in which a second passage (e.g., later-mentioned second passage 14) through which the exhaust gas from combustion chambers of a second cylinder group (e.g., later-mentioned cylinders CY2, CY3) of the internal combustion engine flows is formed, and a junction exhaust pipe (e.g., later-mentioned junction exhaust pipe 46) in which a junction passage (e.g., later-mentioned junction passage 18) merging the exhaust gas flowing through the first passage and the exhaust gas flowing through the second passage is formed. The first passage and the second passage are arranged in parallel. When an inner wall forming the junction passage is divided into a first continuous inner wall (e.g., later-mentioned, first continuous inner wall 461) that continues into an inner wall forming the first passage and a second continuous inner wall (e.g., later-mentioned second continuous inner wall 462) that continues into an inner wall forming the second passage, the exhaust gas sensor is provided in the first continuous inner wall in such a manner as to protrude toward the center of the junction passage. A guide part (e.g., later-mentioned guide portion 22) that protrudes toward the center of the junction passage when viewed in a longitudinal section including the first passage, the second passage, the junction passage, and the exhaust gas sensor, is provided in the first continuous inner wall on the upstream side of the exhaust gas sensor.

(2) In another embodiment, it is preferable that a face of the guide part on the first passage side of the top (e.g., later-mentioned top 221) of the guide part is an inclined surface (e.g., later-mentioned inlet inclined surface 222) inclined toward the center of the junction passage from upstream to downstream sides, and when a face obtained by extending the inclined surface to the downstream side from the top is a virtual extended surface (e.g., later-mentioned virtual extended surface 224), when viewed in the longitudinal section, the virtual extended surface pass through an area closer to the second continuous inner wall than a detection part of the exhaust gas sensor.

(3) In another embodiment, it is preferable that the guide part be separated to the upstream side from the exhaust gas sensor.

(4) In another embodiment, it is preferable that the exhaust system further include an exhaust manifold (e.g., later-mentioned exhaust manifold 5) having a first upstream collecting exhaust pipeline (e.g., later-mentioned first upstream collecting pipeline 11) that guides the exhaust gas from combustion chambers of the first cylinder group to a first exhaust gas inlet (e.g., later-mentioned first exhaust gas inlet 13*a*) of the first collecting exhaust pipe, and a second upstream collecting exhaust pipeline (e.g., later-mentioned second upstream collecting pipeline 12) that guides the exhaust-gas from combustion chambers of the second cylinder group to a second exhaust gas inlet (e.g., later-mentioned second exhaust gas inlet 14*a*) of the second collecting exhaust pipe, the first exhaust gas inlet and the second exhaust gas inlet be formed along a predetermined overlapping direction (e.g., later-mentioned overlapping direction 4A), and the first upstream collecting exhaust pipeline curves larger in the overlapping direction than the second upstream collecting exhaust pipeline.

(5) In another embodiment, it is preferable that a part of the first upstream collecting exhaust pipeline in the vicinity of the first exhaust gas inlet curves larger in the overlapping direction than a part of the second upstream collecting exhaust pipeline in the vicinity of the second exhaust gas inlet.

(1) In one embodiment, the exhaust member includes: a first collecting exhaust pipe in which a first passage is formed, a second collecting exhaust pipe in which a second passage is formed, and a junction exhaust pipe in which a junction passage merging streams of exhaust gas flowing through the first and second passages is formed. Moreover, an inner wall forming the junction, passage is divided, into a first continuous inner wall that continues into an inner wall forming the first passage and a second continuous inner wall that continues into an inner wall forming the second passage, and the exhaust gas sensor is provided in the first continuous inner wall in such a manner as to protrude toward the center of the junction passage. Here, if the exhaust, gas sensor is provided closer to the first-continuous inner wall, that is, closer to the first passage, this may hinder the exhaust gas from the second cylinder group from hitting the exhaust gas sensor. Hence, the exhaust gas sensor is configured to protrude further toward the center of the junction passage. This can bring the exhaust gas sensor-closer to the flow of exhaust gas from the second cylinder group, to allow the exhaust gas from the second cylinder group to hit the exhaust, gas sensor. Also, if the exhaust gas sensor is protruded further toward the center of the junction passage, the intensity with which the exhaust gas from the first cylinder group hits the exhaust gas sensor increases accordingly. This causes imbalance in the intensity of exhaust gas hitting the exhaust gas sensor. Hence, the guide part that protrudes toward the center of the junction passage, that is, protrudes in the protruding direction of the exhaust gas sensor when viewed in a longitudinal section including the first passage, the second passage, the junction passage, and the exhaust gas sensor, is provided in the first continuous inner wall on the upstream side of the exhaust gas sensor. Since the exhaust gas from the first cylinder group is diverted in the protruding direction of the exhaust gas sensor by the guide part, the intensity with which the exhaust gas from the first cylinder group hits the exhaust gas sensor can be weakened accordingly. As a result, the exhaust gas from the first cylinder group and the exhaust gas from the second cylinder group are allowed to evenly hit the exhaust gas sensor. This also enables the exhaust gas sensor to detect the state of exhaust gas from the cylinders in a well-balanced manner.

(2) In another embodiment, a face of the protruding guide part on the first passage side of the top of the guide part forms the inclined surface inclined toward the center of the junction passage from upstream to downstream sides. Additionally, a face obtained by extending the inclined surface to the downstream side from the top is defined as a virtual extended surface. The virtual extended surface passes through an area closer to the second continuous inner wall than the detection part of the exhaust gas sensor when viewed in the longitudinal section. Exhaust gas from the first cylinder group generally flows toward the downstream side along the virtual extended surface. Hence, by providing the virtual extended surface closer to the second continuous inner wall than the detection part of the exhaust gas sensor, the exhaust gas from the first cylinder group and the exhaust gas from the second cylinder group are allowed to more evenly hit the exhaust gas sensor. This also enables the exhaust gas sensor to detect the state of exhaust gas from the cylinders in an even better balance.

(3) In another embodiment, the guide part having the aforementioned function of diverting the exhaust gas from the first cylinder group in the protruding direction of the exhaust gas sensor, is separated to the upstream side from the exhaust gas sensor. If the guide part and the exhaust gas sensor are provided adjacent to each other, the flow of exhaust gas diverted by the guide part may directly hit the exhaust gas sensor and thermally damage the exhaust gas sensor. Thus, the guide part is separated from the exhaust gas sensor to keep the exhaust gas from the first cylinder group from directly hitting the exhaust gas sensor. This can prevent thermal damage in the exhaust gas sensor.

(4) In another embodiment, the exhaust gas from the combustion chambers of the first cylinder group is guided to the first exhaust gas inlet of the first collecting exhaust pipe by the first upstream collecting exhaust pipeline, and the exhaust gas from the combustion chambers of the second cylinder group is guided to the second exhaust gas inlet of the second collecting exhaust pipe by the second upstream collecting exhaust pipeline. Additionally, the first exhaust gas inlet and the second exhaust gas inlet are formed along a predetermined overlapping direction, and the first upstream collecting exhaust pipeline curves larger in the overlapping direction than the second upstream collecting exhaust pipeline. Here, if the first upstream collecting exhaust pipeline is curved larger in the overlapping direction than the second upstream collecting exhaust pipeline, a larger difference occurs in velocity distribution of exhaust gas in the first passage than in the second passage. That is, since the velocity of exhaust gas in the first passage becomes higher on the exhaust gas sensor side than on the second passage side, a difference in the intensity with which to hit the exhaust gas sensor is likely to occur between the exhaust gas from the first cylinder group and the exhaust gas from the second cylinder group. Hence, the guide part is provided in the first continuous inner wall where the velocity of exhaust gas is likely to increase as mentioned earlier. With this, the exhaust gas with increased velocity can be diverted by the guide part, whereby the effect of the guide part can be enhanced.

(5) In another embodiment, a part of the first upstream collecting exhaust pipeline in the vicinity of the first exhaust gas inlet is curved larger in the overlapping direction than a part of the second upstream collecting exhaust pipeline in the vicinity of the second exhaust gas inlet. This causes an even larger difference in velocity distribution of exhaust gas in the first upstream collecting exhaust pipeline than in the second upstream collecting exhaust pipeline. Hence, the guide part is provided in the first continuous inner wall where the velocity of exhaust gas is likely to increase. With this, the exhaust gas with increased velocity can be diverted by the guide part, whereby the effect of the guide part can be enhanced even more. In the above explanation of the exemplary embodiment, specific elements with their reference numerals are indicated by using brackets. These specific elements are presented as mere examples in order to facilitate understanding, and thus, should not be interpreted as any limitation to the accompanying claims.

BRIEF DESCRIPTION OF THE DRAWINGS

The advantages of the disclosure will become apparent in the following description taken in conjunction with the following drawings.

DETAILED DESCRIPTION

Hereinafter, an embodiment of the present disclosure will be described with reference to the drawings.

Figure 1:
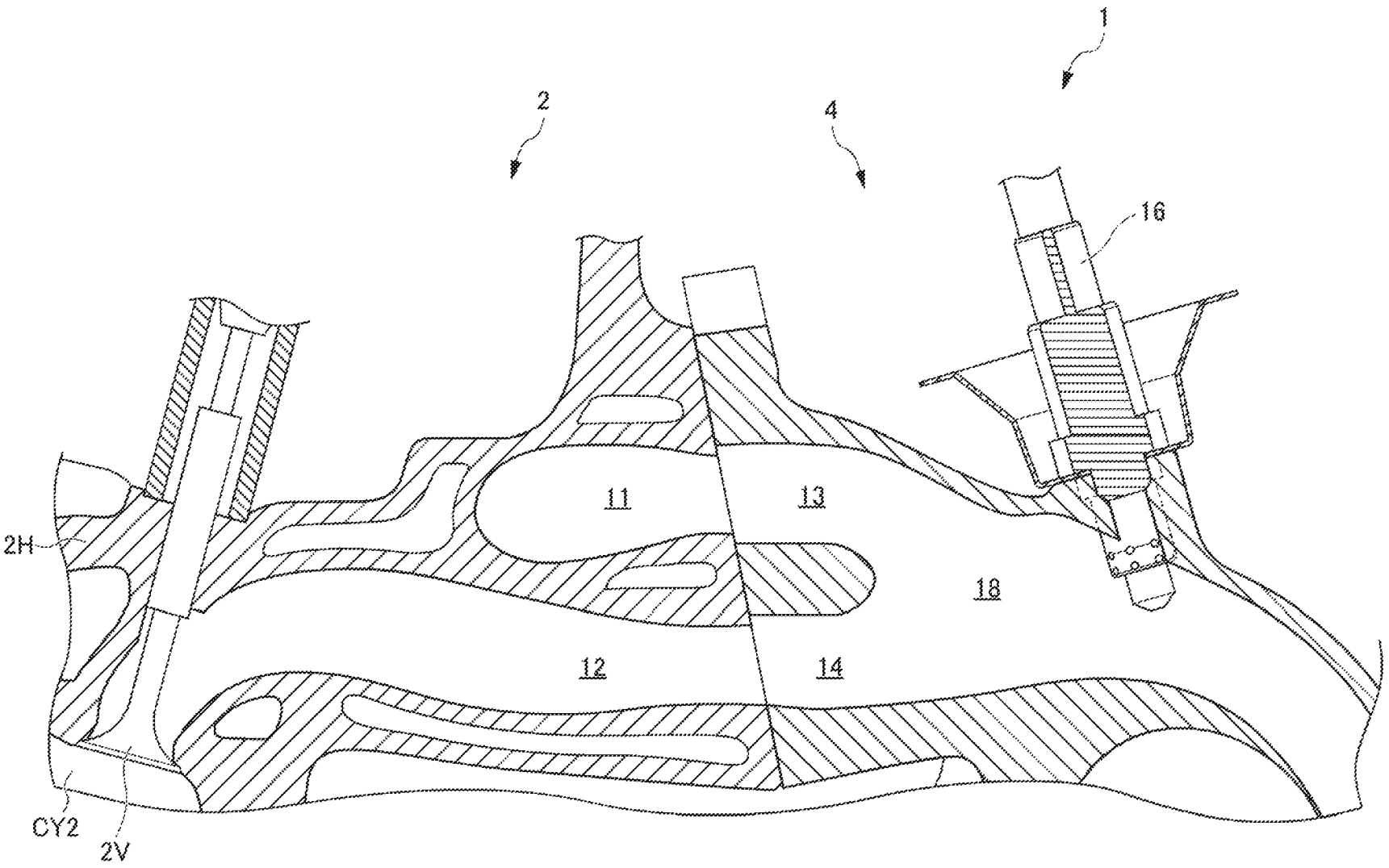
FIG. 1 is a cross-sectional view of as internal combustion engine and a turbine housing connected to the internal combustion engine of one embodiment.

FIG. 1 is a cross-sectional view of an internal combustion engine 2 and a turbine housing 4 that is joined to the internal combustion engine 2. As will be described later with reference to FIG. 2 and other drawings, the internal combustion engine 2 is an inline-four engine configured by arranging multiple, or more specifically, four cylinders in series. FIG. 1 is a cross-sectional view including a third cylinder CY3 of the internal combustion engine 2 and the turbine housing 4.

The internal combustion engine 2 is configured by combining a cylinder block 2B in which multiple cylinders including the third cylinder CY3 are formed, and a cylinder head 2H provided with parts such as multiple exhaust passages that allow passage of exhaust gas discharged from combustion chambers in the cylinders, and exhaust valves 2V. The turbine housing 4 is a part of a turbocharger that compresses intake air of the internal combustion engine 2 by use of energy of exhaust gas of the internal combustion engine 2. The turbine housing 4 has an exhaust passage that introduces the exhaust gas discharged from the combustion chamber of the internal combustion engine 2 into an unillustrated turbine impeller room. Accordingly, when the cylinder head 2H of the internal combustion engine 2 and the turbine housing 4 are joined, a single exhaust passage introducing the exhaust gas to the turbine impeller room from the combustion chamber in each cylinder of the internal combustion engine 2 is formed. Hence, an exhaust system 1 of the internal combustion engine 2 of the embodiment is configured by combining the cylinder head 2H and the turbine housing 4.

Figure 2:
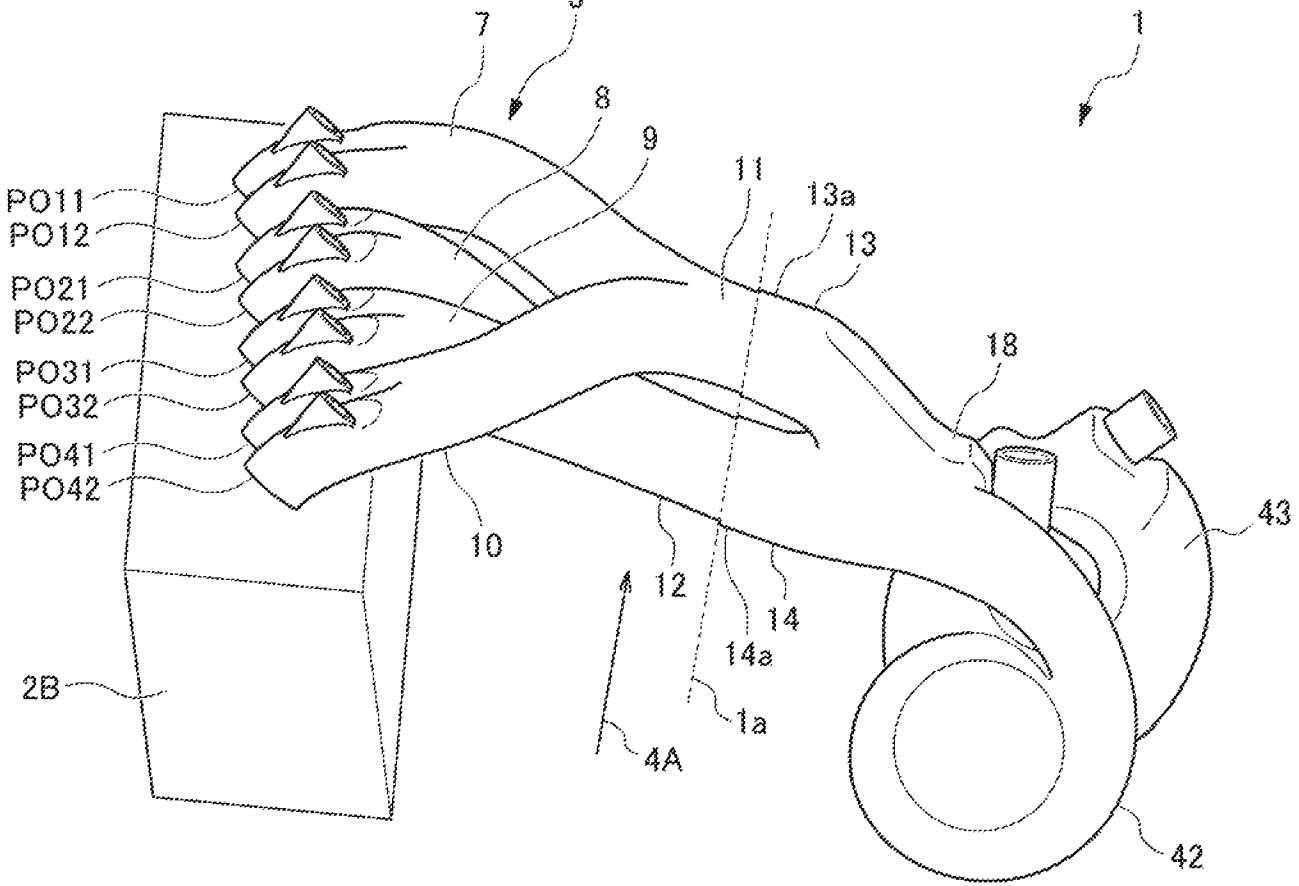
FIG. 2 is a side view of an exhaust passage formed by an exhaust system of an embodiment of the present invention.
Figure 3:
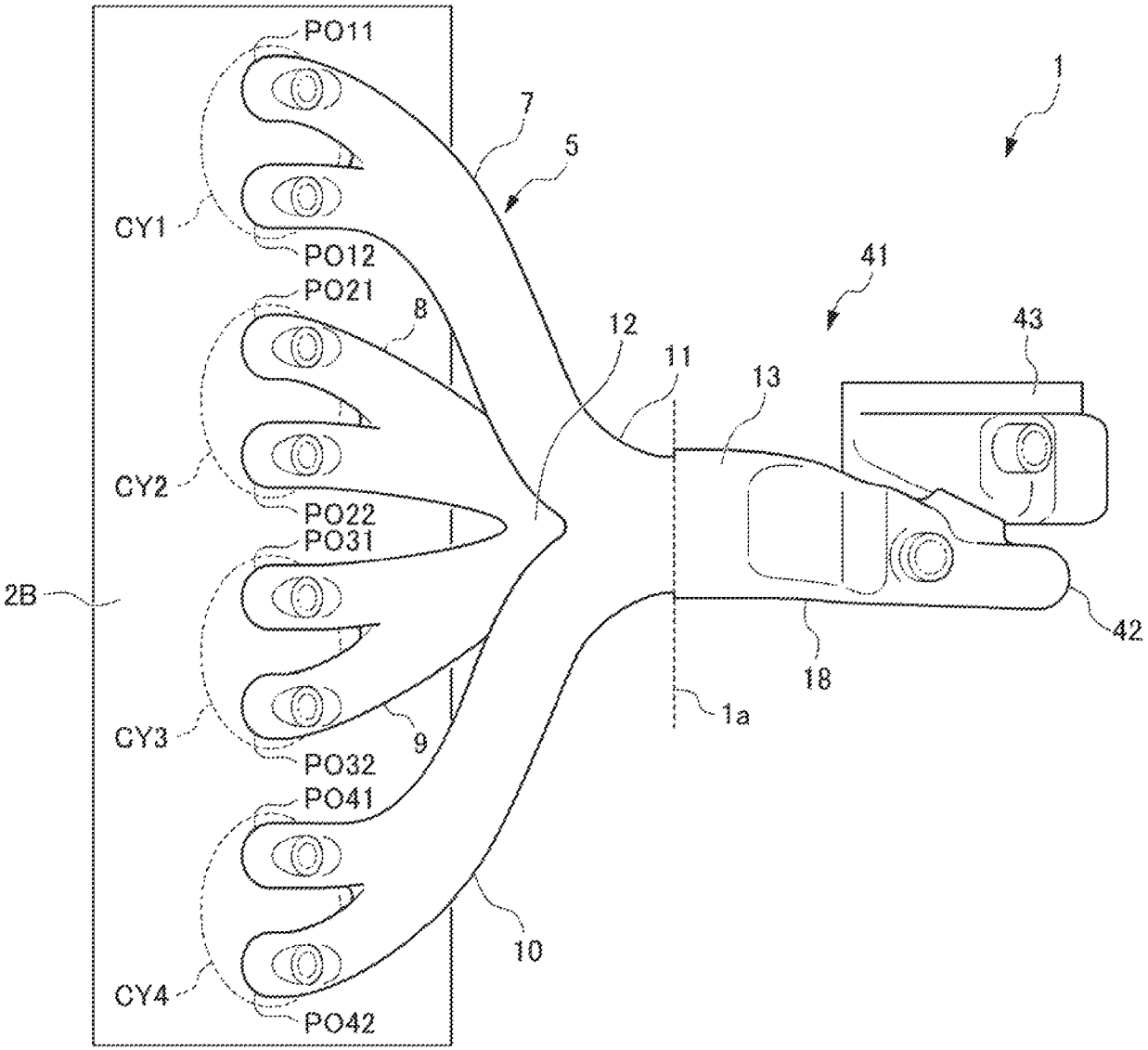
FIG. 3 is a front view of the exhaust passage formed by the exhaust system of an embodiment of the present invention.

FIG. 2 is a side view of the pipe-like exhaust passage formed by the exhaust system 1 of the embodiment. FIG. 3 is a plan view of the exhaust passage. Note that in FIGS. 2 and 3, the cylinder head 2H and the turbine housing 4 are omitted for simplicity of the description, while the exhaust passage and the cylinder block 2B formed by the cylinder head 2H and the turbine housing 4 are indicated by solid lines. In addition, of the exhaust passage illustrated in FIGS. 2 and 3, a part on the left side of a broken line 1*a* is a passage formed by the cylinder head 2H, and a part on the right side of the broken line 1*a* is passage formed by the turbine housing 4. Hereinafter, of the exhaust passage, the passage formed by the cylinder head 2H is also generically called an exhaust manifold 5. Meanwhile, of the exhaust passage, the passage formed by the turbine housing 4 is also generically called a housing passage 41.

As illustrated in FIG. 3, four cylinders CY1, CY2, CY3, CY4 arranged in series are formed in the cylinder block 2B. The exhaust manifold 5 has exhaust ports PO11, PO12 connected to the first cylinder CY1, exhaust ports PO21, PO22 connected to the second cylinder CY2, exhaust ports PO31, PO32 connected to the third cylinder CY3, and exhaust ports PO41, PO42 connected to the fourth cylinder CY4.

The exhaust manifold 5 includes a first bifurcated pipeline 7 connected to the exhaust ports PO11, PO12 on the upstream side, a second bifurcated pipeline 8 connected to the exhaust ports PO21, PO22 on the upstream side, a third bifurcated pipeline 9 connected to the exhaust ports PO31, PO32 on the upstream side, a fourth bifurcated pipeline 10 connected to the exhaust ports PO41, PO42 on the upstream side, a first upstream collecting exhaust pipeline 11 connected to the first bifurcated pipeline 7 and the fourth bifurcated pipeline 10 on the upstream side and collecting the exhaust gas flowing through the bifurcated pipelines 7, 10, and a second upstream collecting exhaust pipeline 12 connected to the second bifurcated pipeline 8 and the third bifurcated pipeline 9 on the upstream side and collecting the exhaust gas flowing through the bifurcated pipelines 8, 9.

The first bifurcated pipeline 7 is connected to the first cylinder CY1 through the two exhaust ports PO11, PO12 on the upstream side, and includes a Y-shaped junction passage that merges the exhaust gas from the exhaust ports PO11, PO12. The first bifurcated pipeline 7 is connected to the first upstream collecting exhaust pipeline 11 together with the fourth bifurcated pipeline 10 on the downstream side, and guides the exhaust gas from the exhaust ports PO11, PO12 to the first upstream collecting exhaust pipeline 11.

The second bifurcated pipeline 8 is connected to the second cylinder CY2 through the two exhaust ports PO21, PO22 on the upstream side, and includes a Y-shaped junction passage that merges the exhaust gas from the exhaust ports PO21, PO22. The second bifurcated pipeline 8 is connected to the second upstream collecting exhaust pipeline 12 together with the third bifurcated pipeline 9 on the downstream side, and guides the exhaust gas from the exhaust ports PO21, PO22 to the second upstream collecting exhaust pipeline 12.

The third bifurcated pipeline 9 is connected to the third cylinder CY3 through the two exhaust ports PO31, PO32 on the upstream side, and includes a Y-shaped junction passage that merges the exhaust gas from the exhaust ports PO31, PO32. The third bifurcated pipeline 9 is connected to the second upstream collecting exhaust pipeline 12 together with the second bifurcated pipeline 8 on the downstream side, and guides the exhaust gas from the exhaust ports PO31, PO32 to the second upstream collecting exhaust pipeline 12.

The fourth bifurcated pipeline 10 is connected to the fourth cylinder CY4 through the two exhaust ports PO41, PO42 on the upstream side, and includes a Y-shaped junction passage that merges the exhaust gas from the exhaust ports PO41, PO42. The fourth bifurcated pipeline 10 is connected to the first upstream collecting exhaust pipeline 11 together with the first bifurcated pipeline 7 on the downstream side, and guides the exhaust gas from the exhaust ports PO41, PO42 to the first upstream collecting exhaust pipeline 11.

The first upstream collecting exhaust pipeline 11 is connected to the bifurcated pipelines 7, 18 on the upstream side, merges the exhaust gas flowing through the first bifurcated pipeline 7 and the exhaust gas flowing through the fourth bifurcated pipeline 10, and guides the exhaust gas to the downstream turbine housing 4. The first upstream collecting exhaust pipeline 11 is connected to a later-mentioned first passage 13 of the turbine housing 4 on the downstream side. The first upstream collecting exhaust pipeline 11 guides the exhaust gas from the combustion chambers of a first cylinder group configured of the first cylinder CY1 and the fourth cylinder CY4, to the first passage 13 of the turbine housing 4.

The second upstream collecting exhaust pipeline 12 is connected to the bifurcated pipelines 8, 9 on the upstream side, merges the exhaust gas flowing through the second bifurcated pipeline 8 and the exhaust gas flowing through the third bifurcated pipeline 9, and guides the exhaust gas to the downstream turbine housing 4. The second upstream collecting exhaust pipeline 12 is connected to a later-mentioned second, passage 14 of the turbine housing 4 on the downstream side. The second upstream collecting exhaust pipeline 12 guides the exhaust gas from the combustion chambers of a second cylinder group configured of the second cylinder CY2 and the third cylinder CY3, to the second passage 14 of the turbine housing 4.

As illustrated in FIGS. 2 and 3, the housing passage 41 includes, from this order from the upstream side toward the downstream side, the first passage 13 connected to the first upstream collecting exhaust pipeline 11 of the exhaust manifold 5, the second passage 14 connected to the second upstream collecting exhaust pipeline 12 of the exhaust manifold 5, a Y-shaped junction passage 18 connected to the first passage 13 and the second passage 14, an annular scroll passage 42 for accelerating the exhaust gas flowing from the junction passage 18, and an impeller room 43 into which the exhaust gas accelerated by the scroll passage 42 flows and in which an unillustrated turbine impeller is stored.

The first passage 13 is connected to the first upstream collecting exhaust pipeline 11 of the exhaust manifold 5. The exhaust gas from the combustion chambers of the first cylinder group flows through the first passage 13. The second passage 14 is connected to the second upstream collecting exhaust pipeline 12 of the exhaust manifold 5. The exhaust gas from the combustion chambers of the second cylinder group flows through the second passage 14. The junction passage 18 is connected to the first passage 13 and the second passage 14, and merges the exhaust gas flowing through the first passage 13 and the exhaust gas flowing through the second passage 14.

Figure 4:
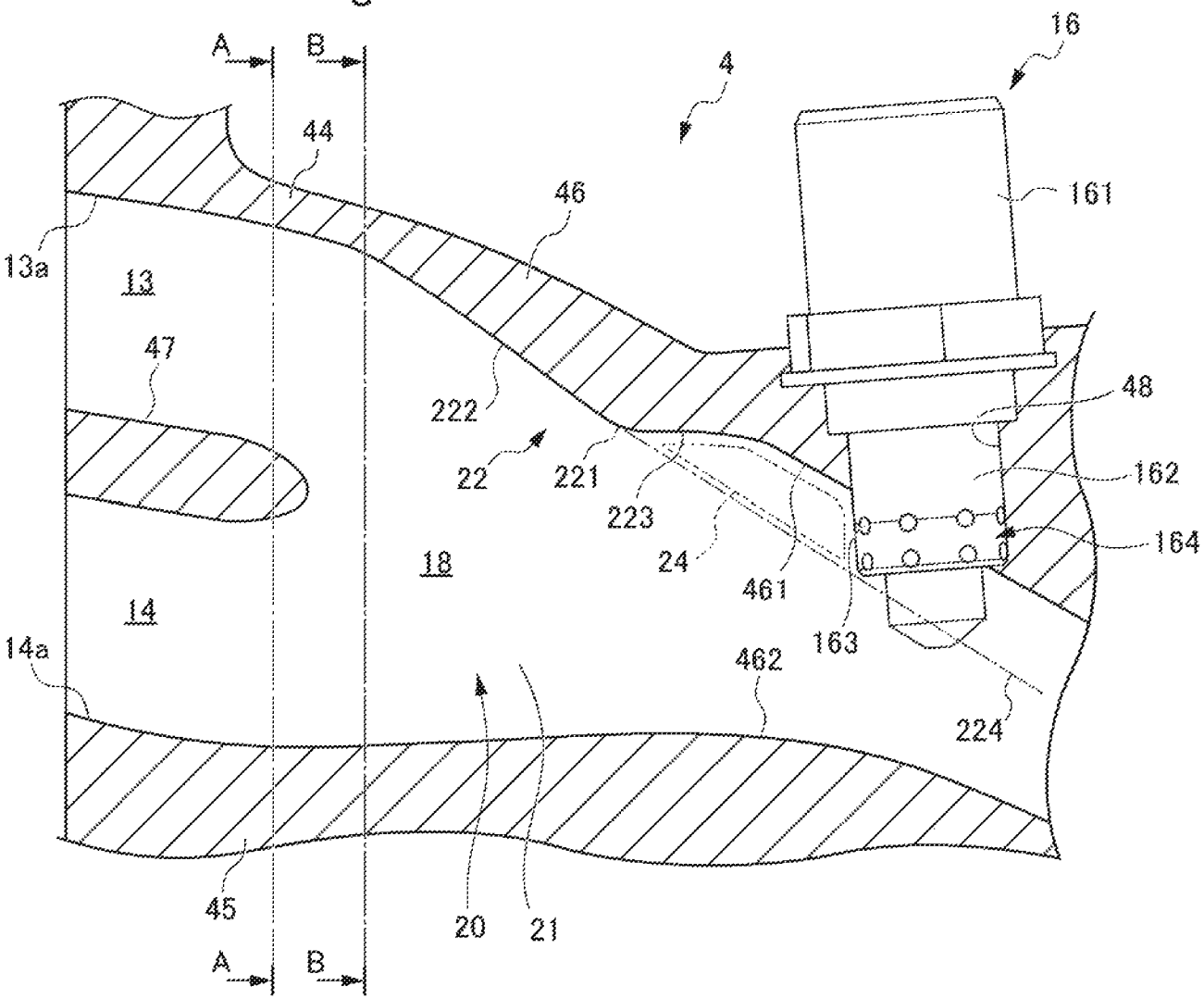
FIG. 4 is a longitudinal section including a first passage, a second passage, and a junction passage of the turbine housing.
Figure 5A:
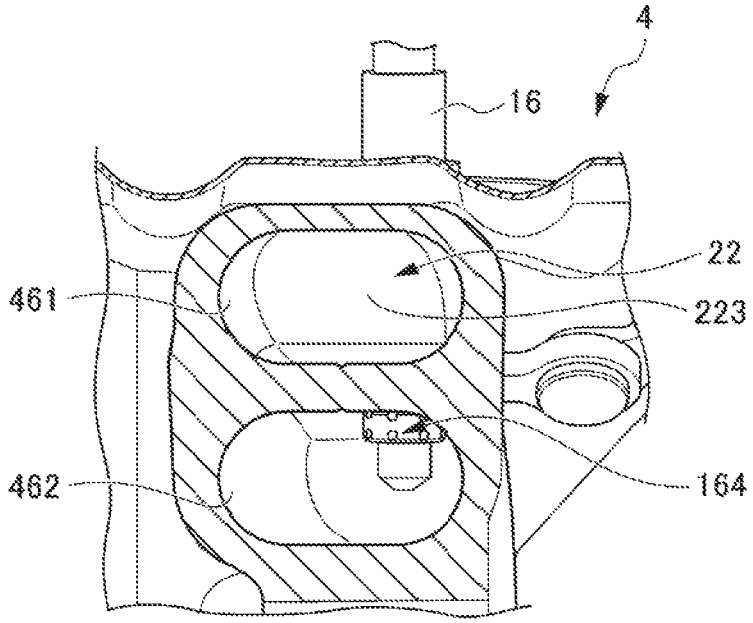
FIG. 5A is a cross-sectional view of the turbine housing taken along line A-A of FIG. 4.
Figure 5B:
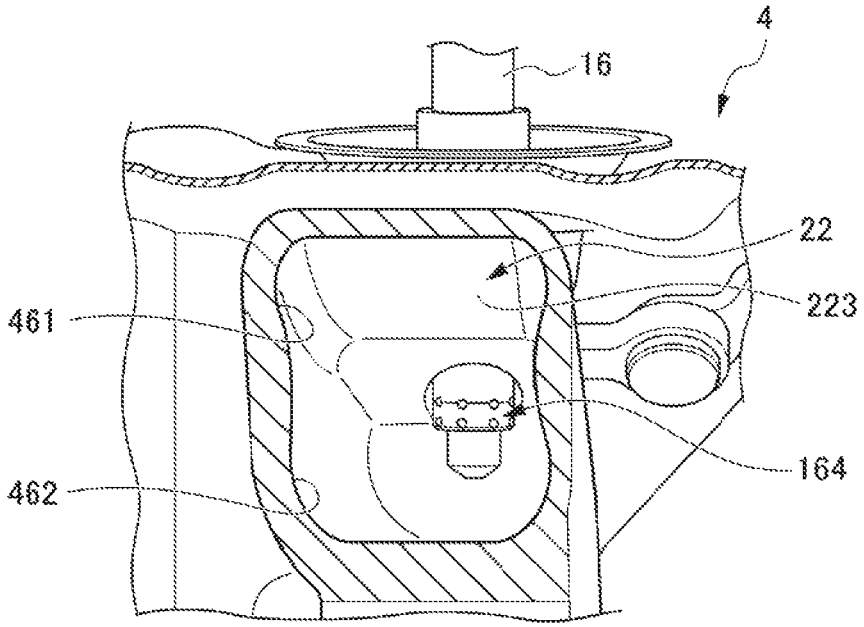
FIG. 5B is a cross-sectional view of the turbine housing taken along line B-B of FIG. 4.

FIG. 4 is a longitudinal section including the aforementioned first passage 13, the second passage 14, and the junction passage 18 of the turbine housing 4. FIG. 5A is a cross-sectional view of the turbine housing 4 taken along line A-A of FIG. 4, and FIG. 5B is a cross-sectional view of the turbine housing 4 taken along line B-B of FIG. 4.

The turbine housing 4 includes a first collecting exhaust pipe 44 in which the aforementioned first passage 13 is formed, a second collecting exhaust pipe 45 in which the aforementioned second passage 14 is formed, a junction exhaust pipe 46 in which the aforementioned junction passage 18 is formed, and a partition wall 47 that separates the first passage 13 from the second passage 14.

As illustrated in FIG. 4, the first passage 13 and the second passage 14 are arranged in parallel. In other words, the first passage 13 and the second passage 14 are arranged side by side, such that their extending directions are parallel to each other. Additionally, as illustrated in FIG. 5A, the first passage 13 and the second passage 14 are substantially rectangular when viewed in the flowing direction of exhaust gas. In addition, a first exhaust gas inlet 13*a* which is an exhaust gas inlet of the first passage 13, and a second exhaust gas inlet 14*a* which is an exhaust gas inlet of the second passage 14, are formed along an overlapping direction 4A which is the vertical direction in FIG. 4. Moreover, as illustrated in FIG. 4, the first exhaust gas inlet 13*a* and the second exhaust gas inlet 14*a* are flush with each other.

As illustrated in FIG. 4, a sensor insertion hole 48 into which an air-fuel ratio sensor 16 is inserted is formed in the junction exhaust pipe 46. When an inner wall that forms the aforementioned junction passage 18 inside the junction exhaust pipe 46 is divided into a first continuous inner wall 461 that continues into an inner wall forming the first passage 13, and a second continuous inner wall 462 that continues into an inner wall forming the second passage 14, the sensor insertion, hole 48 penetrates the first continuous inner wall 461 of the junction exhaust pipe 46. As illustrated in FIG. 4, the sensor insertion hole 48 is slightly inclined relative to the overlapping direction 4A.

The air-fuel ratio sensor 16 includes a substantially bar-shaped main body 161 that has an unillustrated detection electrode part on its tip end part, and a cylindrical cover 162 provided on the tip end part of the main body 161 to protect the aforementioned detection electrode part. Multiple exhaust holes 163 that introduce the exhaust gas outside the cover 162 into the detection electrode inside the cover are formed, on an outer peripheral face of the cover 162. The air-fuel ratio sensor 16 generates a signal corresponding to an air-fuel ratio of exhaust gas flowing into the cover 162 through the exhaust holes 163, and transmits the signal to an unillustrated electronic control unit. Since the air-fuel ratio sensor 16 thus detects the air-fuel ratio of exhaust gas having reached the unillustrated detection electrode part, through the exhaust holes 163 in the cover 162, only a part of the entire cover 162 where the exhaust holes 163 are formed plays a role of detecting the air-fuel ratio of exhaust gas. Hence, in the following description, the part of the air-fuel ratio sensor 16 where the exhaust holes 163 are formed is referred to as a detection portion 164.

As illustrated in FIG. 4, the air-fuel ratio sensor 16 is inserted into the sensor insertion hole 48 of the turbine housing 4, such that the detection portion 164 provided on the tip end thereof protrudes toward the center of the junction passage 18.

When viewed in a longitudinal section including the first passage 13, the second passage 14, the junction passage 18, and the air-fuel ratio sensor 16 as illustrated in FIG. 4, a guide portion 22 protruding toward the center of the junction passage 18 is provided in the first continuous inner wall 461, on the upstream side of the air-fuel ratio sensor 16. As illustrated in FIG. 5B, the edge line of a top 221 of the guide portion 22 extends along a width direction substantially perpendicular to the air-fuel ratio sensor 16. Additionally, as illustrated in FIG. 4, a face of the guide portion 22 on the first passage 13 side of the top 221 forms an inlet inclined surface 222 inclined toward the center of the junction passage 18 from upstream to downstream sides. Meanwhile, a face of the guide portion 22 on the air-fuel ratio sensor 16 side of the top 221 forms an outlet inclined surface 223 inclined toward the center of the junction passage 18 from downstream to upstream sides. As illustrated in FIG. 4, the inlet inclined surface 222 is longer in the flow direction of the exhaust gas than the outlet inclined surface 223.

Additionally, the guide portion 22 is separated to the upstream side from the air-fuel ratio sensor 16. Hence, a gap 24 is provided between the air-fuel ratio sensor 16 and the guide portion 22. Here, assume that a face obtained by extending the inclined surface 222 of the guide portion 22 to the downstream side of the top 221 as indicated by an alternate long and short dash line in FIG. 4 is a virtual extended surface 224. When viewed in a longitudinal section including the first passage 13, the second passage 14, the junction passage 18, and the air-fuel ratio sensor 16, the virtual extended surface 224 passes through an area closer to the second continuous inner wall 462 than the detection portion 164 of the air-fuel ratio sensor 16 such that the virtual extended surface 224 is positioned such that a distance between the virtual extended surface 224 and the second continuous inner wall 462 is smaller than a distance between the detection part 164 of the exhaust gas sensor and the second continuous inner wall 462. Hence, the exhaust gas from the combustion chambers of the first cylinder group flows through the first passage 13, and is diverted in the protruding direction (i.e., toward the center of the junction passage 18) of the air-fuel ratio sensor 16 by the guide portion 22. In other words, the guide portion 22 has a function of weakening the intensity with which the exhaust gas from the first cylinder group hits the detection portion 164 of the air-fuel ratio sensor 16.

Here, the reason for providing the above guide portion 22 on the first continuous inner wall 461 side will be explained. As illustrated in FIG. 2, the exhaust manifold 5 guides the exhaust gas from the combustion chambers of the first cylinder-group to the first exhaust gas inlet 13*a* through the first upstream collecting exhaust pipeline 11, and guides the exhaust gas from the combustion chambers of the second cylinder group to the second exhaust gas inlet 14*a* through the second upstream collecting exhaust pipeline 12. Additionally, due to limitation in layout, the first upstream collecting exhaust pipeline 11 curves larger in the overlapping direction 4A of the inlets 13*a*, 14*a* than the second upstream collecting exhaust pipeline 12. More specifically, a part of the first upstream collecting exhaust pipeline 11 in the vicinity of the first exhaust gas inlet 13*a* curves larger in the overlapping direction 4A than a part of the second upstream collecting exhaust pipeline 12 in the vicinity of the second exhaust gas inlet 14*a*. For this reason, a larger difference occurs in velocity distribution of exhaust gas in the first passage 13 than in the second passage 14. That is, since the first upstream collecting exhaust pipeline 11 curves more largely, the velocity of exhaust gas in the first passage 13 becomes higher on the first continuous inner wall 461 side than on the second passage 14 side. This tends to cause a difference in the intensity with which the exhaust gas hits the air-fuel ratio sensor 16, between the exhaust gas from the first cylinder group and the exhaust gas from the second cylinder group. Accordingly, in the exhaust system 1 of the embodiment, the guide portion 22 having a function of weakening the intensity with which the exhaust gas hits the air-fuel ratio sensor 16 is provided on the first-continuous inner wall 461 side, to cancel out the difference in velocity distribution of exhaust gas.

The exhaust system 1 of the embodiment has the following effects.

(1) The turbine housing 4 of the embodiment includes the first collecting exhaust pipe 44 in which the first passage 13 is formed, the second collecting exhaust pipe 45 in which the second passage 14 is formed, and the junction exhaust pipe 46 in which the junction passage 18 merging the streams of exhaust gas flowing through the passages 13, 14 is formed. In addition, in the embodiment, the inner wall that forms the junction passage 18 is divided into the first continuous inner wall 461 that continues into the inner wall forming the first passage 13, and the second continuous inner wall 462 that continues into the inner wall forming the second passage 14, and the air-fuel ratio sensor 16 is provided in the first continuous inner wall 461 in such a manner as to protrude toward the center of the junction passage 18. Here, if the air-fuel ratio sensor 16 is provided closer to the first continuous inner wall 461, that is, closer to the first passage 13, this may hinder the exhaust gas from the second cylinder group from hitting the air-fuel ratio sensor 16. Hence, in the embodiment, the air-fuel ratio sensor 16 is configured to protrude further toward the center of the junction passage 18. This can bring the air-fuel ratio sensor 16 closer to the flow of exhaust gas from the second cylinder group, to allow the exhaust gas from the second cylinder group to hit the air-fuel ratio sensor 16. Also, if the air-fuel ratio sensor 16 is protruded further toward the center of the junction passage 18, the intensity with which the exhaust gas from the first cylinder group hits the air-fuel ratio sensor increases accordingly. This causes imbalance in the intensity of exhaust gas hitting the air-fuel ratio sensor 16. Hence, in the embodiment, the guide portion 22 that protrudes toward the center of the junction passage 18, that is, protrudes in the protruding direction of the air-fuel ratio sensor 16 when viewed in a longitudinal section including the first passage 13, the second passage 14, the junction passage 18, and the air-fuel ratio sensor 16, is provided in the first continuous inner wall 461 on the upstream side of the air-fuel ratio sensor 16. Since the exhaust gas from the first cylinder group is diverted in the protruding direction of the air-fuel ratio sensor 16 by the guide portion 22, the intensity with which the exhaust gas from the first cylinder group hits the air-fuel ratio sensor 16 can be weakened accordingly. As a result, the exhaust gas from the first cylinder group and the exhaust gas from the second cylinder group are allowed to evenly hit the air-fuel ratio sensor 16. This also enables the air-fuel ratio sensor 16 to detect the state of exhaust, gas from the cylinders in a well-balanced manner.

(2) In the embodiment, a face of the protruding guide portion 22 on the first passage 13 side of the top 221 forms the inlet inclined surface 222 inclined toward the center of the junction passage 18 from upstream to downstream sides. Additionally, in the embodiment, a face, obtained by extending the inlet inclined surface 222 to the downstream side of the top 221 is defined as the virtual extended surface 224. The virtual extended surface 224 passes through an area closer to the second continuous inner wall 462 than the detection portion 164 of the air-fuel ratio sensor 16 when viewed in the aforementioned longitudinal section. The exhaust gas from the first cylinder group generally flows toward the downstream side along the virtual extended surface 224. Hence, by providing the virtual extended surface 224 closer to the second continuous inner wall 462 than the detection portion 164 of the air-fuel ratio sensor 16, the exhaust gas from the first cylinder group and the exhaust, gas from the second cylinder group are allowed to more evenly hit the air-fuel ratio sensor 16. This also enables the air-fuel ratio sensor 16 to detect the state of exhaust gas from the cylinders in an even better balance.

(3) In the embodiment, the guide portion 22 having the aforementioned function of diverting the exhaust gas from the first cylinder group in the protruding direction of the air-fuel ratio sensor 16, is separated to the upstream side from the air-fuel ratio sensor. If the guide portion 22 and the air-fuel ratio sensor 16 are provided adjacent to each other, the flow of exhaust gas diverted by the guide portion 22 may directly hit the air-fuel ratio sensor 16 and thermally damage the air-fuel ratio sensor 16. In the embodiment, the guide portion 22 is separated from the air-fuel ratio sensor to keep the exhaust gas from the first cylinder group from directly hitting the air-fuel ratio sensor. This can prevent thermal damage in the air-fuel ratio sensor 16.

(4) In the exhaust manifold 5 of the embodiment, the exhaust gas from the combustion chambers of the first cylinder group is guided to the first exhaust gas inlet 13*a* of the first collecting exhaust pipe 44 by the first upstream collecting exhaust pipeline 11, and the exhaust gas from the combustion chambers of the second cylinder group is guided to the second exhaust gas inlet 14*a* of the second collecting exhaust pipe 45 by the second upstream collecting exhaust pipeline 12. Additionally, the first exhaust gas inlet 13*a* and the second exhaust gas inlet 14*a* are formed along the overlapping direction 4A, and the first upstream collecting exhaust pipeline 11 curves larger in the overlapping direction 4A than the second upstream collecting exhaust pipeline 12. Here, if the first upstream collecting exhaust pipeline 11 is curved larger in the overlapping direction 4A than the second upstream collecting exhaust pipeline 12, a larger difference occurs in velocity distribution of exhaust gas in the first passage 13 on the downstream side than in the second passage 14. Hence, in the embodiment, the guide portion 22 is provided in the first continuous inner wall 461 where the velocity of exhaust gas is likely to increase, from among the first passage 13 and the second passage 14. With this, the exhaust gas with increased velocity can be diverted by the guide portion 22, whereby the effect of the guide portion 22 can be enhanced.

(5) In the embodiment, a part of the first upstream collecting exhaust pipeline 11 in the vicinity of the first exhaust gas inlet 13*a* is curved larger in the overlapping direction 4A than a part of the second upstream collecting exhaust pipeline 12 in the vicinity of the second exhaust gas inlet 14*a*. This causes an even larger difference in velocity distribution of exhaust gas in the first upstream collecting exhaust pipeline 11 than in the second upstream collecting exhaust pipeline 12. Hence, in the embodiment, the guide portion 22 is provided in the first continuous inner wall 461 where the velocity of exhaust gas is likely to increase, from among the first passage 13 and the second passage 14. With this, the exhaust gas with increased velocity can be diverted by the guide portion 22, whereby the effect of the guide portion 22 can be enhanced even more.

Note that the present invention is not limited to the above embodiment, and modifications, improvements, and the like within the scope of achieving the objective of the disclosure are included in the invention. Although a specific form of embodiment has been described above and illustrated in the accompanying drawings in order to be more clearly understood, the above description is made by way of example and not as limiting the scope of the defined by the accompanying claims. The scope of the invention is to be determined by the accompanying claims. Various modifications apparent to one of ordinary skill in the art could be made without departing from the scope of the invention. The accompanying claims cover such modifications.

The invention claimed is:

1. An exhaust system of an internal combustion engine comprising:

an exhaust member that constitutes a part of an exhaust passage through which exhaust gas of a multi-cylinder internal combustion engine flows, the multi-cylinder internal combustion engine including a first cylinder group and a second cylinder group; and an exhaust gas sensor that is provided in the exhaust member, wherein:

the exhaust member includes a first collecting exhaust pipe comprising a first passage through which exhaust gas from combustion chambers of the first cylinder group of the internal combustion engine flows, a second collecting exhaust pipe comprising a second passage through which exhaust gas from combustion chambers of the second cylinder group of the internal combustion engine flows, and a junction exhaust pipe comprising a junction passage merging the exhaust gas flowing through the first passage and the exhaust gas flowing through the second passage;

the first passage and the second passage are arranged parallel to each other such that the first passage and the second passage respectively have an extending direction parallel to each other, wherein an inner wall constituting the junction passage includes a first continuous inner wall that continues into an inner wall of the first passage and a second continuous inner wall that continues into an inner wall of said second passage, the exhaust gas sensor is provided in the first continuous inner wall in such a manner as to protrude from the first continuous inner wall toward the center of the junction passage, and the first continuous inner wall includes a guide part (i) that protrudes toward the center of the junction passage and (ii) that is inclined toward the center of the junction passage relative to the extending direction from upstream side to downstream side when viewed in a longitudinal section including the first passage, the second passage, the junction passage, and the exhaust gas sensor, the guide part being provided on the upstream side of the exhaust gas sensor.

2. The exhaust system of an internal combustion engine according to claim 1, wherein:

the guide part includes a protruding peak, a face of the guide part on the upstream side of the protruding peak of the guide part is an inclined surface inclined toward the center of the junction passage from the upstream side to the downstream side, and when a virtual extended surface is obtained by extending the inclined surface to the downstream side from the protruding peak, when viewed in the longitudinal section, the virtual extended surface is positioned such that a distance between the virtual extended surface and the second continuous inner wall is smaller than a distance between a detection part of the exhaust gas sensor and the second continuous inner wall.

3. The exhaust system of an internal combustion engine according to claim 1, wherein the guide part is separated toward the upstream side from the exhaust gas sensor.

4. The exhaust system of an internal combustion engine according to claim 1, wherein:

the exhaust system further comprises an exhaust manifold including a first upstream collecting exhaust pipeline that guides exhaust gas from the combustion chambers of the first cylinder group to a first exhaust gas inlet of the first collecting exhaust pipe, and a second upstream collecting exhaust pipeline that guides exhaust gas from the combustion chambers of the second cylinder group to a second exhaust gas inlet of the second collecting exhaust pipe;

the first exhaust gas inlet and the second exhaust gas inlet are disposed along a predetermined overlapping direction;

the first upstream collecting exhaust pipeline curves larger in the overlapping direction than the second upstream collecting exhaust pipeline; and wherein the exhaust manifold is disposed on upstream side of the exhaust member and the exhaust manifold and the exhaust member are individual members.

5. The exhaust system of an internal combustion engine according to claim 4, wherein a part of the first upstream collecting exhaust pipeline located in the vicinity of the first exhaust gas inlet curves larger in the overlapping direction than a part of the second upstream collecting exhaust pipeline located in the vicinity of the second exhaust gas inlet.

6. The exhaust system of an internal combustion engine according to claim 1, wherein the first continuous inner wall and the second continuous inner wall are disposed opposite to each other.

7. The exhaust system of an internal combustion engine according to claim 1, wherein the guide part deviates the exhaust gas flowing through the first passage from a detection part of the exhaust gas sensor.

8. The exhaust system of an internal combustion engine according to claim 1, wherein the first passage and the second passage are connected to the junction passage.

9. A vehicle comprising the exhaust system of an internal combustion engine according to claim 1.

* * * * *